United States Patent [19]

Lubie

[11] Patent Number: 4,946,162

[45] Date of Patent: Aug. 7, 1990

[54] PORTABLE EXERCISE APPARATUS

[76] Inventor: Nathan F. Lubie, 1041 N.E. 204 Terrace, No. Miami Beach, Fla. 33179

[21] Appl. No.: 330,653

[22] Filed: Mar. 30, 1989

[51] Int. Cl.[5] ..... A63B 21/008

[52] U.S. Cl. ..... 272/130; 272/70; 272/96; 272/900

[58] Field of Search ..... 272/69, 70, 130, 134, 272/900, 96

[56] References Cited

U.S. PATENT DOCUMENTS

| | | | |
|---|---|---|---|
| 3,421,760 | 1/1969 | Freeman, Jr. | 272/900 X |
| 3,749,400 | 7/1973 | Stoffell . | |
| 3,970,302 | 7/1976 | McFee | 272/130 |
| 4,262,902 | 4/1981 | Dranselka | 272/900 X |
| 4,364,559 | 12/1982 | Valentine | 272/900 X |
| 4,422,635 | 12/1983 | Herod | 272/96 |
| 4,496,147 | 1/1985 | DeCloux et al. | 272/130 |
| 4,561,649 | 12/1985 | Forsythe | 272/96 |
| 4,563,001 | 1/1986 | Teraudes . | |
| 4,676,501 | 6/1987 | Hoagland et al. | 272/70 |
| 4,685,669 | 8/1987 | DeCloux | 272/130 |

FOREIGN PATENT DOCUMENTS

| | | | |
|---|---|---|---|
| 8003104 | 12/1980 | Netherlands | 272/130 |

*Primary Examiner*—Robert W. Bahr

*Attorney, Agent, or Firm*—Robert M. Schwartz; Edward I. Mates

[57] ABSTRACT

Compact and portable exercise apparatus is disclosed. A frame assembly having a wedge type of shape comprising aluminum structural members has mounted thereto a pair of hydraulic cylinders which are interconnected by a hydraulic flow line containing an adjustable needle valve. The other end of the hydraulic cylinders is connected to a foot pedal which allows the force of a person's downward push of his legs to act upon the resistance provided within the hydraulic circuitry and which automatically causes the opposite foot pedal travel upward. The exercise apparatus is intended to primarily be used in conjunction with a person sitting in an ordinary chair.

7 Claims, 3 Drawing Sheets

PORTABLE EXERCISE APPARATUS

BACKGROUND OF THE INVENTION

1. Field of the Invention

In general this invention relates to portable exercise apparatus and in particular to compact exercise apparatus, which is capable of being used in a home, office, or other non-commercial or even a commercial training or exercising facility, which apparatus may in general be used in a sitting or supine body position and by which the lower and upper body portions can be individually exercised.

2. Description of the Prior Art

Indeed, there are many different and various exercise apparatus on the market today. Even more exercise apparatus have reached the prototype stage and might even have been patented; but, from a commercial standpoint they were never successful. That this is so is because for portable exercise apparatus to be commercially successful it must work repeatedly as intended, be capable of being manufactured on a mass production basis, must be inexpensive, must be convenient to use and must provide the workout said to be capable of being achieved. Notwithstanding the plethora of various exercise apparatus, both portable and nonportable, on the market today, none is truly compact, affordable, and yet provides real exercise. Furthermore, few, if any, can be used while a person doing the exercise is in a sitting position in a common and ordinary household or office chair. Thus, there exists the need for a truly portable, compact, and useful exercise apparatus as provided by the present invention which is described and claimed herein.

Accordingly, the primary goal of the present invention is to provide exercise apparatus which is compact and portable and still provides real exercise.

Another object of the present invention is to provide portable exercise apparatus which is simple in construction and operation and therefore may be repeatedly used over a long period of time.

Another object of the present invention is to provide portable exercise apparatus which may be used for primarily strengthening the lower portion of the body but also provide for strengthening the upper portion of the body.

Yet another object of the present invention is to provide portable exercise apparatus. Which provides for variable resistance so that people of all ages and strengths and even some people having minor disabilities may utilize the exercise apparatus.

Still another object of the present invention is to provide portable exercise apparatus which may be used by people sitting in ordinary home or office type chairs, for example, as when watching television.

SUMMARY OF THE INVENTION

The present invention provides for the above-stated objectives as well as others by providing simple but effective portable exercise apparatus which may be used by a person sitting in an ordinary chair or lying in a supine position.

The exercise apparatus provided for herein comprises a main frame having a wedged type of overall appearance made up of common I beams, channel beams, and box beams as structural components. A pair of hydraulic cylinders are rigidly attached to the frame at one end and extend along the length of the obliquely angled member of the frame. The other end of the hydraulic cylinders is attached to an axle rod which is oriented in a transverse but horizontal position and adapted to move along the length of the obliquely angled members along tracks comprising the channel formed by the I beam sections and the U channel beam sections of the structural members. Limb-engaging pedals, later referred to as foot pedals are attached to the axle rods for rotational movement about the longitudinal axis of the axle rods. Finally, the hydraulic cylinders are connected together by hydraulic tubing with a needle valve positioned within the hydraulic line. By manipulating the needle valve the force of resistance of each of the hydraulic cylinders may be increased or decreased appropriately. When one of the foot pedals is moved downward along the angled support members, the other hydraulic cylinder and the foot pedal attached thereto moves in the opposite or upward direction therealong.

In the event that the force of resistance is adjusted to a strong position, it is possible that the frame of the portable exercise apparatus will move along the surface on which it is placed. In order to avoid this undesired motion, the framing may be attached to a flexible pad which extends from the exercise apparatus to under a chair used by the person and whose weight secures the pad as well as the portable exercise apparatus in place. As an alternative to the pad, flexible straps extending from the rear of the exercise device may be hand held by the person using the exercise apparatus.

When not in use, the portable exercise apparatus may be stored in an ordinary closet, while taking up the space of only one shelf thereof.

Various other objects, advantages and features of the invention will become apparent to those skilled in the art from the following discussion taken in conjunction with the following drawings, in which:

DESCRIPTION OF THE PREFERRED EMBODIMENTS

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Figure 1:
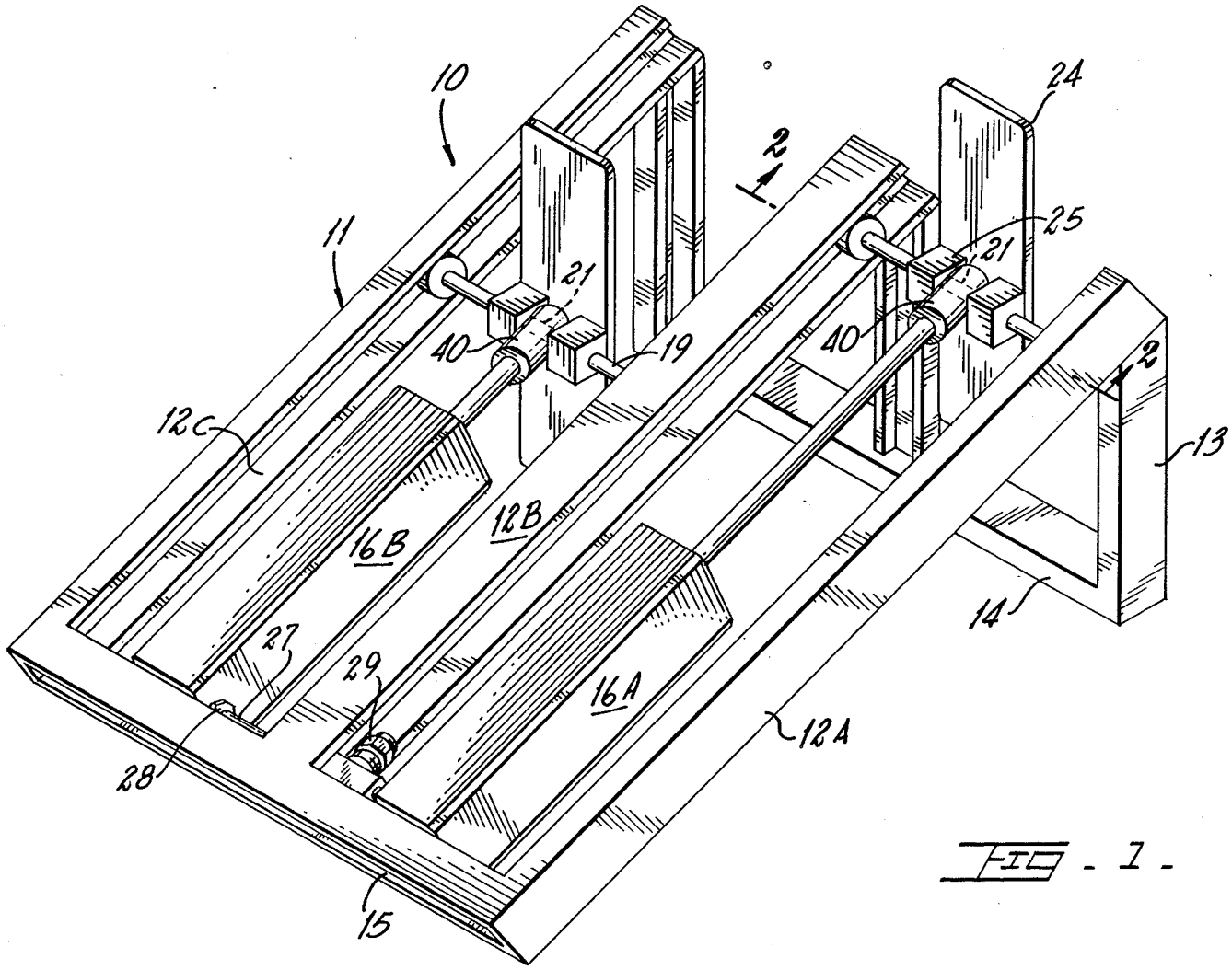
FIG. 1 is an isometric overall view of the inventive exercising apparatus illustrating the simplicity and the operational functions thereof.

Reference is now made to the drawings wherein like characteristics and features of the present invention shown in the various figures are designated by the same reference numerals Referring now to the various figures, particularly FIG. 1, there is illustrated therein, the overall appearance and functional operation of the inventive portable exercise apparatus 10. A main frame assembly 11 includes three elongated structural members which are angled approximately 30° to the horizontal. The angled members 12A and 12C each may have a U-shaped beam cross section conforming to half the cross-section of I-beam member 12B so as to provide the necessary structural support and comprise guide tracks for the movement of the foot pedals of the exercise apparatus as more fully explained hereinafter. A vertical member 13, which may have a box cross-sectional shape, is attached to each of the angled members 11. Cross box beam members 14 are attached to the vertical members 13 at the lower elevation thereof. Also, a channel beam member 15 is attached to the ground level of the angled beam members 12A, 12B and 12C at the front of the apparatus 10. All the connections between the various beam members are fixed so as to obtain a solid and strong frame assembly 11. By making each of the frame members 12, 13, 14, and 15 from aluminum, a lightweight and strong frame member is obtained. However, other suitable materials such as steel or plastic may be used for the frame members 12, 13, and 14.

Hydraulic cylinders 16A and 16B are attached at their bottom end to cross beam member 15. This connection is rigid. The rod or stem members 17 extending from hydraulic cylinder 16 is attached at one end within the hydraulic cylinder to a piston 18 and through a transversely apertured stem adapter 40 at its other end to an axle rod 19 which extends transversely across the opening between the angled support member 12. Axle rod 19 extends through a hole 21 provided in stem adapter 40 of the hydraulic cylinders 16 as shown in FIG. 2.

Figure 2:
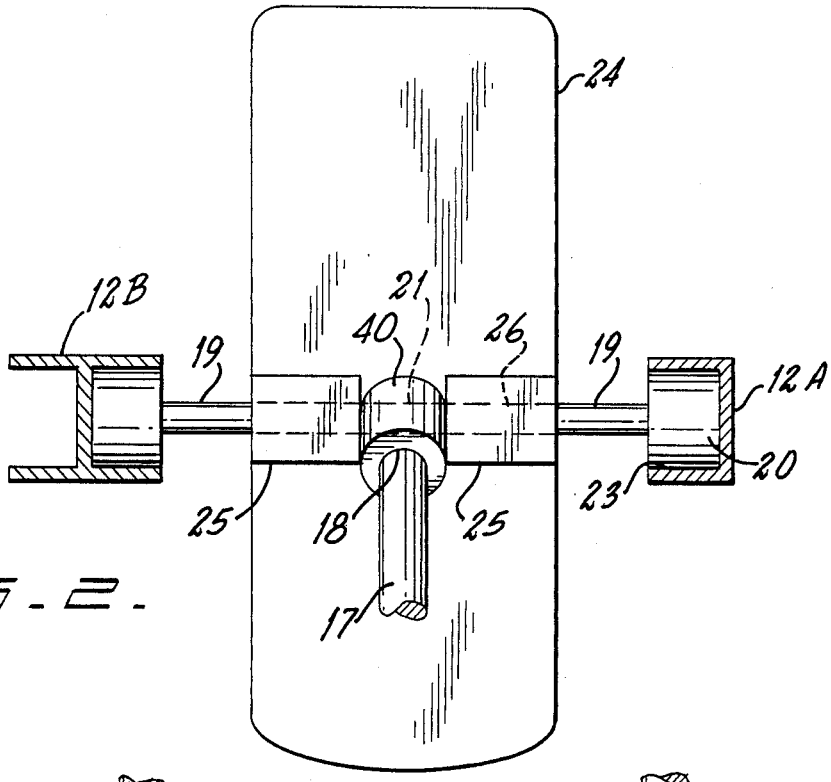
FIG. 2 is a detailed view of the pivotally attached foot pedals and guide system taken through the line 2—2 of FIG. 1.

Still referring to FIG. 2, the ends of axle rod 19 are provided with rollers 20 which may roll about a non-rotating axle rod 19, or in the alternative roll with a rotating axle rod 19. A foot pedal 24 having mounting lugs 25 attached to a bottom surface thereof. Each lug 25 is provided with a transversely extending hole 26 within which extends axle rod 19. Accordingly, foot pedal 24 is pivotally attached to axle rod 19. Axle rod 19 is moveable lengthwise within the channels 23 formed by the cross-sectional shape of I beam member 12B and channel beam members 12A and 12C.

As shown in the drawings, hydraulic cylinders 16 are side-by-side arranged and each is associated with a foot pedal.

Figure 3:
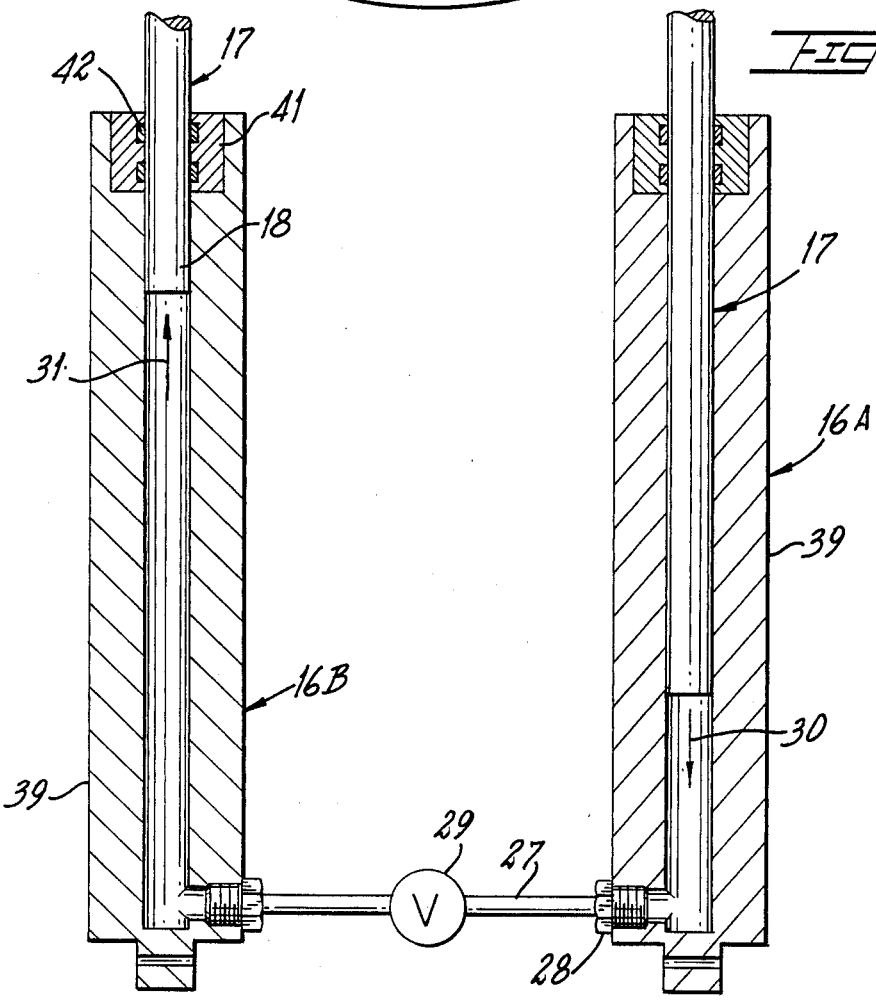
FIG. 3 is a schematic drawing of the hydraulic circuit and flow pad used in the invention apparatus.
Figure 4:
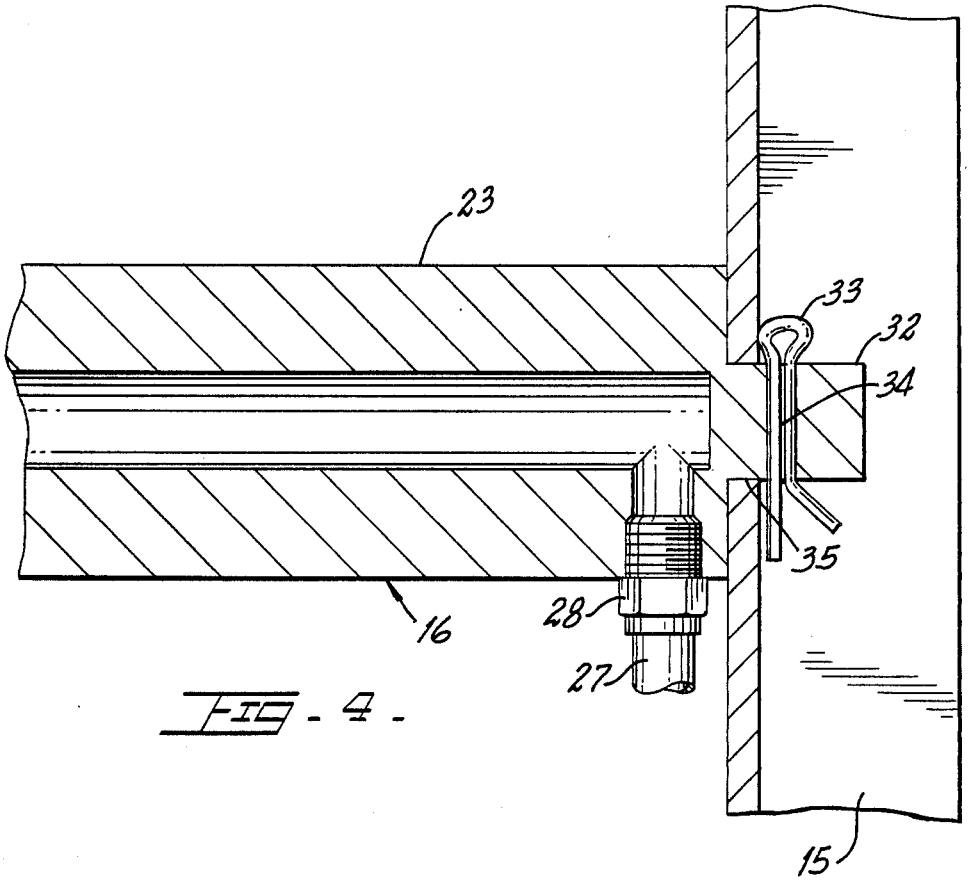
FIG. 4 is a detailed plan view of the hydraulic cylinder attachment means at the bottom thereof to the main frame of the exercise apparatus; and, FIG. 5 is a schematic side view of the inventive apparatus equipped with both a strap and a flexible pad.
Figure 5:
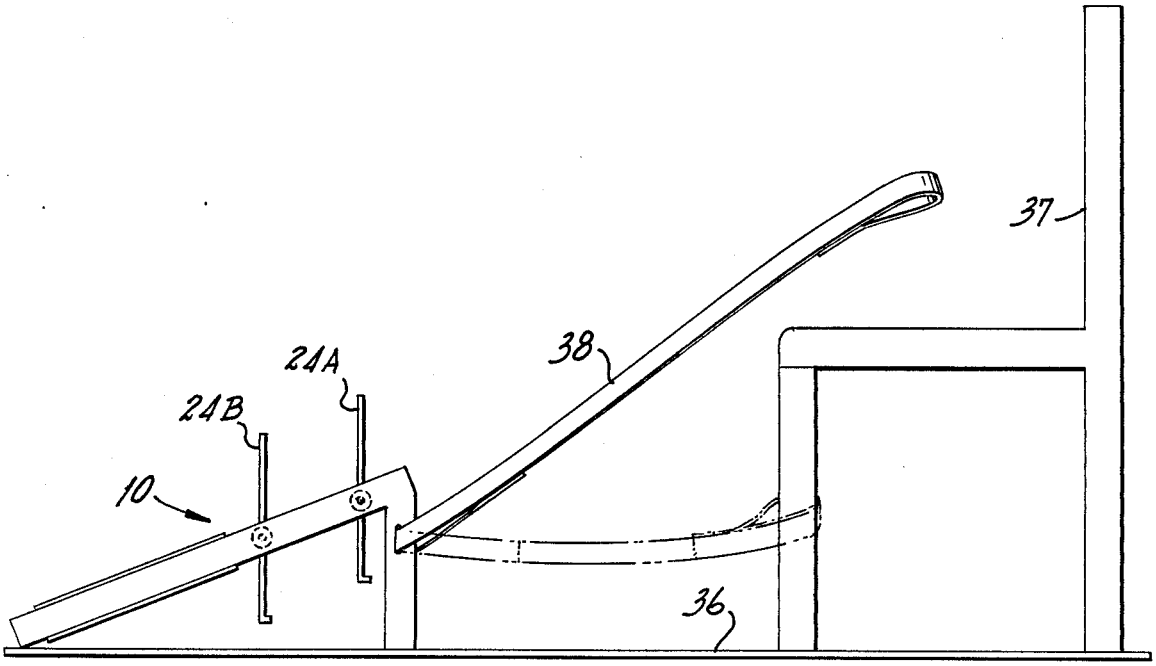

Refer now also to FIGS. 3, 4, and 5 which show various other details. Each of the hydraulic cylinders 16 may comprise a body 39 which may, for example, be molded from a material such as nylon. Within the body 39 of hydraulic cylinder 16, the piston 18 comprises rod 17 and by the use of bushing 41 and seal rings 42, is sealingly fitted to the interior bore of hydraulic cylinder 16. This arrangement compensates for the tendency of piston 18 from moving transverse to the axis of cylinder 16. The pushing force on the foot pedal 24 causes piston 18 of hydraulic cylinder 16A to move downward within hydraulic cylinder 16A forcing the oil or hydraulic fluid within hydraulic cylinder 16A to pass through hydraulic line 27 which couples the remote ends of hydraulic cylinders 16A and 16B. As the hydraulic fluid within hydraulic cylinder 16A moves downward in the direction of arrow 30, the piston 18 and stem assembly 17 of cylinder 16B are caused to move upward in the same direction as arrow 31. Thus, while either one of the foot pedals 24A or 24B move in one direction, the other foot pedal moves in the opposite direction. The downward motion is the only motion which experiences resistance as provided by the hydraulic circuit. A needle valve 29 attached within hydraulic line 27 may be utilized to vary the amount of resistance provided by the inventive apparatus 10. Reinforcing structure 28 is provided for hydraulic line 27 (FIG. 3). By further closing the valve 29, the force required to move the hydraulic fluid from one hydraulic cylinder assembly, for example, 16A to the other cylinder assembly 16B is increased. Conversely, by further opening needle valve 29, the resistance provided by moving the hydraulic fluid from one cylinder to the other results in a lesser foot pedal force being required.

In FIG. 4 one method of attaching the bottom end of the housing 23 of hydraulic cylinder 16 to cross frame member 15 is shown. In this embodiment, a lug 32 which may be molded integrally with housing 23, extends from the bottom thereof and through a hole 35 in frame member 15. A cotter or a split pin 33 may be mounted in a hole 34 transversely positioned through mounting lug 32 in order to removably secure the lower or remote ends of the hydraulic cylinder 16 to the cross bar 15 of frame assembly 11. Other obvious methods, such as screws or studs, may be used to provide equivalent rigid mounting.

During use of the exercise apparatus 10, a person would position himself in a chair 37 in front of the vertical portion of the inventive apparatus 10 (FIG. 5). This will orient the foot pedals 24 in front of the hydraulic cylinders 16 and in line therewith. Thus, the angled members and the hydraulic cylinders would be oriented in the position extending downward and away from the person using the exercise apparatus 10. The distance that the inventive apparatus 10 is placed away from or toward the chair determines which part of the leg muscles would be more exposed to the exercise. However, should the upper leg muscles in general be desired to be exercised, the apparatus may be placed in front of the person such that when one of his legs is substantially fully extended, the foot pedal and hydraulic assembly associated with such foot is depressed at the maximum downward position. This would cause a nominal bending at the knee at the person's other leg which is resting on the other foot pedal which is located in its maximum upward location. Then, the person simply moves the bent leg down while the other leg moves up. This is a continual repeating cycle so as to cause the legs to be moving in an upward and downward motion somewhat similar to that provided by the pedals of a moving bicycle. As described above, by adjusting needle valve 29 more or less resistance to the leg motions may be obtained. The person doing the exercise determines the amount of exercise he desires by adjusting the needle valve 29 and by adjusting the velocity of the cyclic up-and-down motion of his legs.

When using the portable exercise apparatus provided for by this invention in a moderate or medium level of exercising, the friction between the bottom feet of the exercise apparatus 10 will generally stay in fixed contact with the ground beneath the exercise apparatus. In the event that a high degree of exercising is desired, it is possible for the frame assembly 11 of the invention apparatus 10 to slide along the ground and away from the person doing the exercising. In this situation it is necessary to prevent the frame assembly 11 from so sliding by providing one or the other of the means shown in FIG. 5 to fix the movement of the exercise apparatus 10.

In one embodiment a pliable rug or mat 36 is permanently affixed to the feet or lower end of the frame members 11 which are in contact with the ground. The end of the mat or rug 36 extending away from the frame assembly 11 is to be located under the chair 37 of the person using the exercise apparatus 10. His weight will keep the mat 36 in place and its permanent attachment to the frame member will prevent the exercise apparatus 10 from sliding forward when high or excessive force is used.

In the alternative, flexible straps 38 may be attached to the vertical end of frame member 11 at one end and be hand held by the person using the exercise apparatus at the other end of the straps, or may be attached to the chair 37. In this manner, the resistance provided to prevent the frame assembly 11 from moving forward is provided by the hand held straps.

While the inventive apparatus 10 is primarily intended to be utilized by a person sitting in an ordinary chair and for the purpose of exercising his legs, it may be utilized to exercise the upper body portions also. In the latter situation, the person using the exercise apparatus 10 would position himself in a kneeling position in front of the heightened portion of the frame assembly 11 and place his hands one each on the appropriate pedal. Then, the person would move each alternative hand in a upward and downward motion to obtain the exercise desired. Similarly, the person using the exercise apparatus may lie in a supined position on his back and with his feet against the pedals then proceed to use the exercise apparatus in the manner intended. In this latter situation, it would be preferable to have the mat or rug 36 attached to the bottom of the legs of the frame assembly 11.

While the invention has been described, disclosed, illustrated and shown in certain terms or certain embodiments or modifications which it has assumed in practice, the scope of the invention is not intended to be nor should it be deemed to be limited thereby and such other modifications or embodiments as may be suggested by the teachings herein are particularly reserved especially as they fall within the breadth and scope of the claims here appended.

I claim as my invention:

1. Portable exercise apparatus comprising a frame assembly comprising a plurality of angled structural support members including a plurality of obliquely angled guide channels and a plurality of vertical support members each extending downward from one end of an angled member so as to comprise vertical legs, a hydraulic resistance apparatus attached to the frame assembly comprising a pair of side-by-side hydraulic cylinders flow connected together by a hydraulic line having resistance adjusting means attached thereto, each of said hydraulic cylinders having a piston and stem axially movable relative to its associated hydraulic cylinder, a transversely apertured stem adapter fixed to an end of each said stem, a pair of transversely apertured mounting lugs, one on each side of said stem adapter, an axle rod extending through each said transversely apertured stem adapter and said pair of transversely apertured mounting lugs, a limb-engaging pedal rigidly secured to said pair of mounting lugs to pivot therewith relative to said axle rod, said axle rod having a roller at each end thereof and fitted within said obliquely angled guide channels formed within the angled structural support members, whereby said pedal is free to pivot in response to movement of said axle rod in response to movement of a limb of a person using said exercise apparatus.

2. The exercise apparatus of claim 1, wherein said frame assembly comprises a cross member, said hydraulic cylinders being fixedly attached at their remote ends to said cross member.

3. The exercise apparatus of claim 1, wherein said angled support members comprise three support beams including a center beam having an I shaped cross section and two outer beams each having a U shaped cross section.

4. The apparatus of claim 3, wherein said guide channels comprise the channels formed within a center structural support member having an I beam cross section and end structure support members each having a U beam cross section.

5. The apparatus of claim 1, wherein said exercise apparatus comprises flexible mat means attached to the ground contacting portions of said frame assembly and extending from an end of said frame assembly in one direction a distance of approximately three feet or greater.

6. The apparatus of claim 1, wherein said exercise apparatus comprises flexible straps each connected at one end to the vertical end of said exercise apparatus, said straps having a length of approximately two feet or more.

7. The apparatus of claim 1, wherein said hydraulic cylinders comprise a seal between said cylinder and said stem being located in the upper portion of said cylinder whereby the piston is prevented from moving in an angled direction relative to said cylinder and said upper location of said seal maintains said sealing relationship.

* * * * *